US005787504A

United States Patent [19]

Wu

[11] Patent Number: 5,787,504

[45] Date of Patent: Aug. 4, 1998

[54] FOLDABLE BAG ATTACHED TO A FABRIC ARTICLE

[76] Inventor: Jiao-Yih Wu, No. 213, Hsi Hsien, 1st Street, West Dist., Tainan, Taiwan

[21] Appl. No.: 922,441

[22] Filed: Sep. 3, 1997

[51] Int. Cl.[6] ..... A41D 1/02; B65D 30/00

[52] U.S. Cl. ..... 2/93; 383/4

[58] Field of Search ..... 383/4, 37, 40; D02/828, 830, 839; 2/69.5, 93, 94

[56] References Cited

U.S. PATENT DOCUMENTS

| | | | |
|---|---|---|---|
| 2,437,223 | 3/1948 | Dutrow | D2/839 |
| 4,078,264 | 3/1978 | DeGennaro et al. | 383/4 |
| 5,490,619 | 2/1996 | Boyar | 383/37 |

*Primary Examiner*—C. D. Crowder
*Assistant Examiner*—Tejash D. Patel
*Attorney, Agent, or Firm*—Rosenberg, Klein & Bilker

[57] ABSTRACT

A foldable bag attached to a fabric article mainly including a fabric article, such as a coat, and small and larger bag sewn at one edge to the fabric article, such that the fabric article can be easily folded and received in the small bag via an opening of the small bag, and the small bag with the fabric-made article received therein can be easily contained in the larger bag by turning the big bag inside out. The larger bag also has an opening through which many other articles can be put into the larger bag along with the small bag and the folded fabric article packed in the small bag for convenient carrying and managment.

3 Claims, 4 Drawing Sheets

FOLDABLE BAG ATTACHED TO A FABRIC ARTICLE

BACKGROUND OF THE INVENTION

Due to changeful weather, there are chances we put on heavy clothes to keep warm when we went out in the cold morning and then faced a fierce sun in the afternoon, forcing us to take off the heavy clothes. For parents who have a baby or babies with them when they go out, additional clothes are always necessary in case of suddenly changed weather. These heavy or additional clothes simply become a burden when they are not in use due to changed weather, particularly when they are carried during outdoor activities. It is therefore desirable to have a bag for convenient gethering and carrying of these heavy or additional clothes while this bag needs not to be separately prepared.

SUMMARY OF THE INVENTION

A primary object of the present invention is to provide a foldable fabric-article-attached bag which allows a fabric-made article to which the bag is attached to be conveniently received in the bag while the bag can be used to accommodate other articles at the same time.

BRIEF DESCRIPTION OF THE DRAWINGS

The structure and features of the present invention can be best understood from the following detailed description of the preferred embodiments and the accompanying drawings, wherein.

DETAILED DESCRIPTION OF THE PREFERRED EMBODIMENTS

The present invention relates to a foldable fabric-article-attached bag. According to a preferred embodiment of the present invention, there is provided a fabric-made article, preferably a garment, and a small and a big bags sewed at one edge to a predetermined position on the fabric article, such that the fabric article can be easily folded and received in the small bag via an opening of the small bag adjecent to the sewed edge, and the small bag having the fabric article received therein can be easily contained in the big bag by turning the big bag inside out via an opening on the big bag opposite to the sewed edge. The big bag with the small bag contained therein can then be used as, for example, a back pack to conveniently contain other articles along with the folded fabric-made article.

Figure 1A:
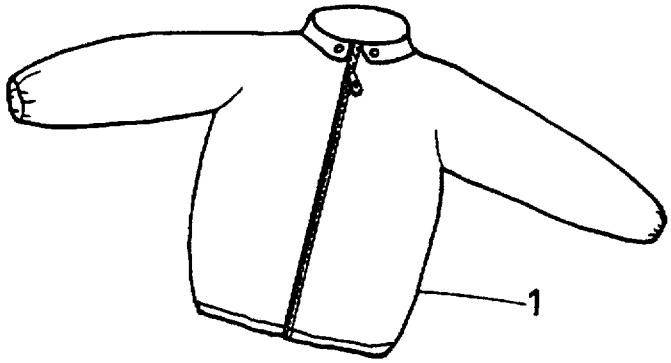
FIG. 1*a* shows a coat to which the bag according to a first emboditment of the present invention is attached.
Figure 1B:
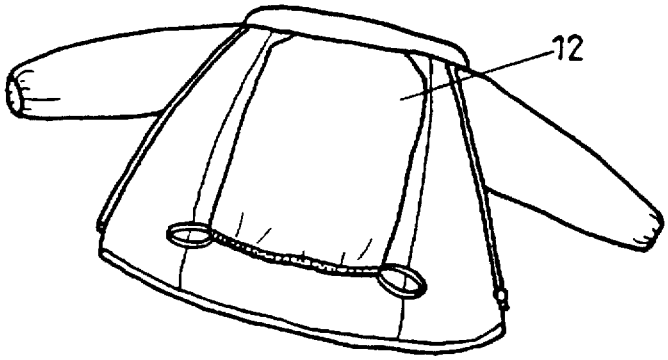
FIG. 1*b* shows the coat of FIG. 1*a* in an opened state to reveal a big bag attached thereto.
Figure 1C:
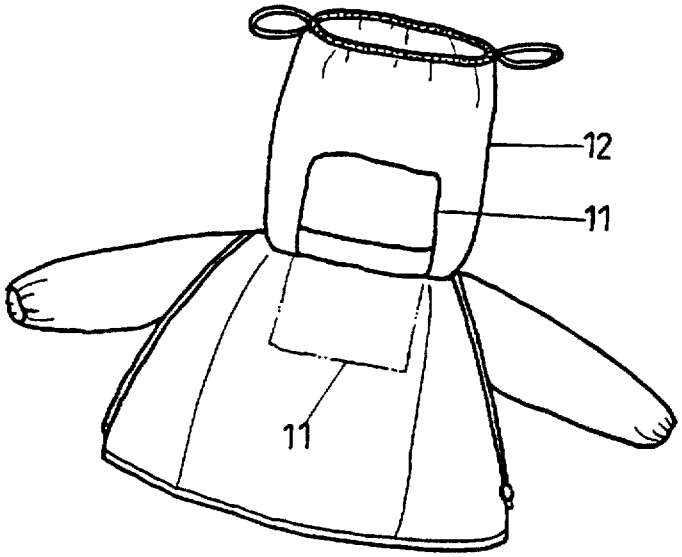
FIG. 1*c* shows the coat-attached big bag being turned upward to reveal a small bag between the big bag and the coat.

A preferred example of the fabric-made article is a coat 1 as shown in FIG. 1*a*. When the coat 1 is opened as shown in FIG. 1*b*, it can be seen that a big bag 12 is sewed along an edge to an inner back portion of the coat 1 below a collar portion and has an opening which faces downward when the big bag 12 loosely hangs from the collar portion. Please refer to FIG. 1*c*. When the big bag 12 is pivotally turned upward relative to the coat 1, it can be seen that a small bag 11 is also sewed to the inner back portion of the coat 1 below the collar portion and is located between the big bag 12 and the inner back portion of the coat 1. The small bag 11 has an opening which faces upward when the small bag 11 loosely hangs from the collar portion of the coat 1.

Figure 1D:
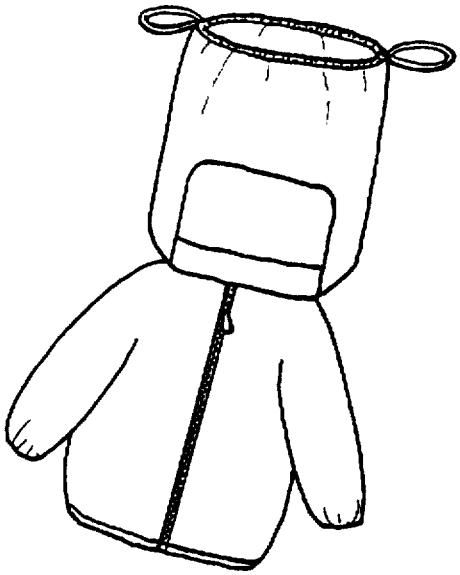
FIG. 1*d* shows the first step to fold the coat for receiving in the small bag.
Figure 1E:
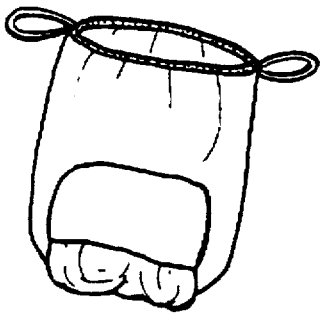
FIG. 1*e* shows the second step to push the folded coat into the small bag.
Figure 1F:
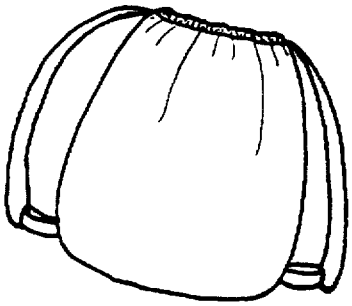
FIG. 1*f* shows the third step to turn the big bag inside out to contain the small bag in the big bag.

Please now refer to FIGS. 1*d*, 1*e*, and 1*f*. The coat 1 can be folded to a small volume and be received in the small bag 11 which has been turned to an outside of the coat 1. The small bag 11 and the coat 1 received therein can thereafter be together contained in the big bag 12 by turning the big bag 12 inside out. At this point, the big bag 12 may function like, for example, a back pack as shown in FIG. 1*f* for conveniently containing more articles therein, such as nursing bottles, diapers, etc., in the case these articles are carried by a baby's parent along with other additionally prepared clothes, that is, the coat 1.

Figure 2:
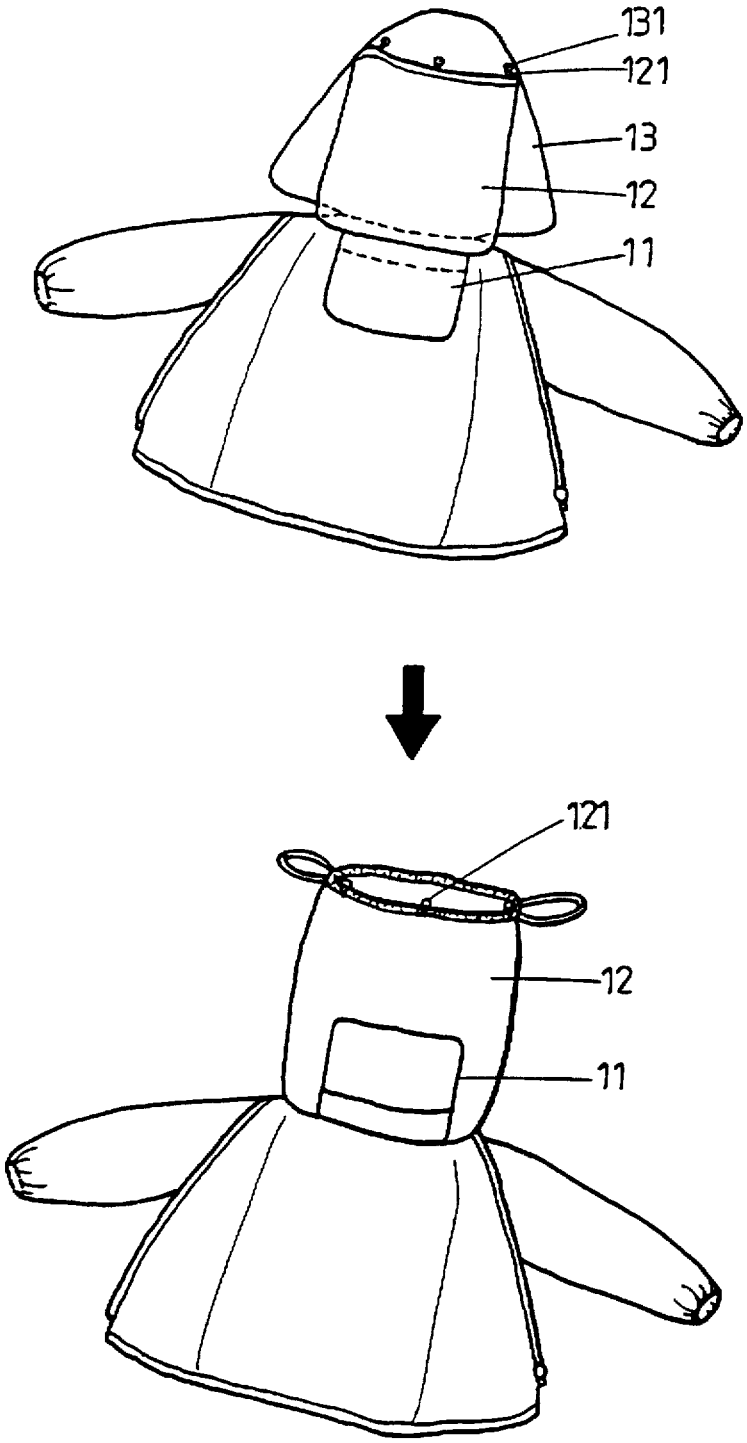
FIG. 2 shows another coat to which the bag according to a second embodiment of the present invention is attached, and the manner of managing the bag to receive the coat therein.

FIG. 2 shows another embodiment of the present invention. The fabric-made article shown in FIG. 2 is a coat 1 with a hood 13 attached to the back portion along the collar portion. Fastening means 131 are provided to an inner side of the hood 13. A big bag 12 is provided at an outer surface facing the hood 13 with fastening means 121 correcponding to the fastening means 131, so that the big bag 12 can be pivotally turned upward to attach to the hood 13 without loosely hanging from the collar portion of the coat 1 when it is not in use. And, when the coat 1 is folded and received in a small bag 11 similarly sewed to the coat 1 as in the above first example, the big bag 12 can be detached from the hood 13 by disengaging the fastening means 121 from 131 and then be used to contain the small bag 11 loaded with the coat 1.

Figure 3:
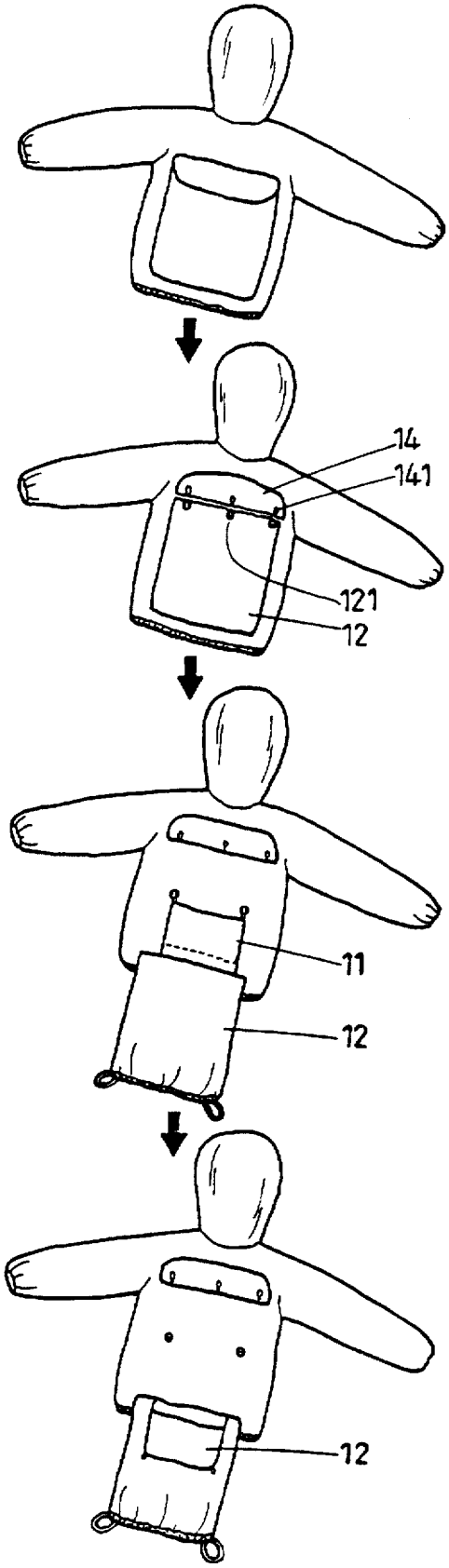
FIG. 3 shows still another coat to which the bag according to a third embodiment of the present invention is attached, and the steps of managing the bag to receive the coat therein.

FIG. 3 shows a further embodiment of the present invention. The fabric-made article shown in FIG. 3 is a coat 1 similar to that of FIG. 2. In this embodiment, the small and the big bags 11, 12 are sewed to an outer back portion of the coat 1. A flap 14 is sewed to the outer back portion of the coat 1 below the hood. Fastening means 141 are provided at an inner surface of the flap 14 to engage with fastening means 121 correspondingly provided on a top outer surface of the big bag 12 along an opening thereof while the big bag 12 is sewed at a bottom edge to the back portion of the coat 1. When the big bag 12 is not in use, it can be pivotally turned upward to attach to the flap 14 by engaging the fastening means 121 with 141 without loosely hanging from the coat 1. And, to use the big bag 12, simply detach it from the flap 14 and to expose the small bag 11. The small bag 11 is also detachably attached at a top edge to the back portion of the coat 1 with a bottom edge sewed to the coat 1. After the small and the big bags 11, 12 are pivotally turned downward, they can be used to pack the coat 1 in the same manner as described in the above first and the second embodiments.

The fabric-made article is not limited to a coat or other garments. It can be a back pack or other bags, too.

The advantages of the present invention are as follows:

1. The fabric-made article can be packed in the small bag to form a compact body which is in turn contained in the big bag and therefore occupies only a very small volume in the big bag.

2. The fabric-made article can be received in the small bag which is in turn contained in the big bag along with other articles. Many individual articles can be conveniently received in a whole space provided by the big bag integrally formed with the fabric-made article without being dispersed here and there.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A foldable bag attached to a fabric article, comprising a fabric article, and a small bag and a larger bag each sewn at one edge to a predetermined position on said fabric article, such that said fabric article can be easily folded and received in said small bag via an opening of said small bag adjacent to said sewn edge, and said small bag having said fabric article received therein can be easily contained in said larger bag by turning said larger bag inside out via an opening on said larger bag opposite to said sewn edge, and said larger bag with said small bag contained therein can then be used to conveniently contain other articles along with said fabric article folded and packed in said small bag.

2. A foldable bag attached to a fabric article as claimed in claim 1, wherein said fabric article is a coat.

3. A foldable bag attached to a fabric article as claimed in claim 1, wherein said small bag and said larger bags are provided with fastening means to detachably engage with fastening means correspondingly provided on said fabric article, preventing said small bag and said larger bag from loosely hanging from said fabric article.

* * * * *